United States Patent [19]

Federighi et al.

[11] 4,218,264

[45] Aug. 19, 1980

[54] DISHWASHER UTILIZING PUMP IMPELLER SUCTION FOR FEEDING DETERGENT, SANITIZING AGENT AND RINSE AID IN TIMED SEQUENCES

[76] Inventors: George J. Federighi; George B. Federighi, both of 70 Thirteenth St., San Francisco, Calif. 94105

[21] Appl. No.: 18,994

[22] Filed: Mar. 9, 1979

[51] Int. Cl.[2] ..... B08B 3/02

[52] U.S. Cl. ..... 134/95; 134/101; 68/17 R; 68/207; 222/136

[58] Field of Search ..... 134/58 D, 94–95, 134/100–101; 68/17 R, 207; 222/136, 382

[56] References Cited

U.S. PATENT DOCUMENTS

| | | | |
|---|---|---|---|
| 2,592,886 | 4/1952 | Fox et al. | 134/95 X |
| 2,718,481 | 9/1955 | Tuthill | 134/95 X |
| 3,021,863 | 2/1962 | Low | 134/100 X |
| 3,702,680 | 11/1972 | Woehler | 134/58 D X |
| 4,029,260 | 6/1977 | Herrick | 134/100 X |

*Primary Examiner*—Robert L. Bleutge
*Attorney, Agent, or Firm*—Alvin E. Hendricson; William R. Piper

[57] ABSTRACT

A commercial dishwasher having a wash/rinse compartment for receiving dishes and a tank below the compartment for receiving wash or rinse water after a motor driven impeller has circulated the water from the tank and has forced it through spray arms in the compartment employs the suction created by the impeller for removing a detergent from a container in timed sequence by an entraining action during the wash cycle and mixing the detergent with the wash water during the dishwashing cycle. This same suction created by the impeller is employed for simultaneously removing a sanitizing liquid from a container and a rinse aid liquid from another container and mixing these two liquids with a rinse water during the rinsing and sterilizing cycle in timed sequence.

4 Claims, 8 Drawing Figures

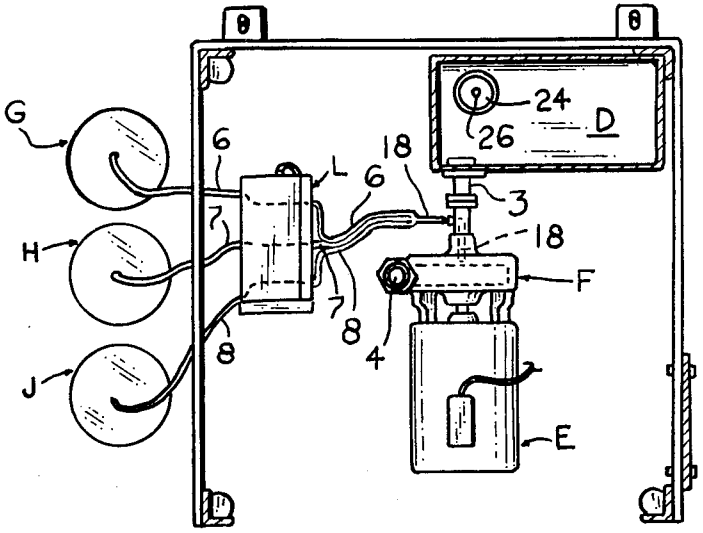
FIG-1
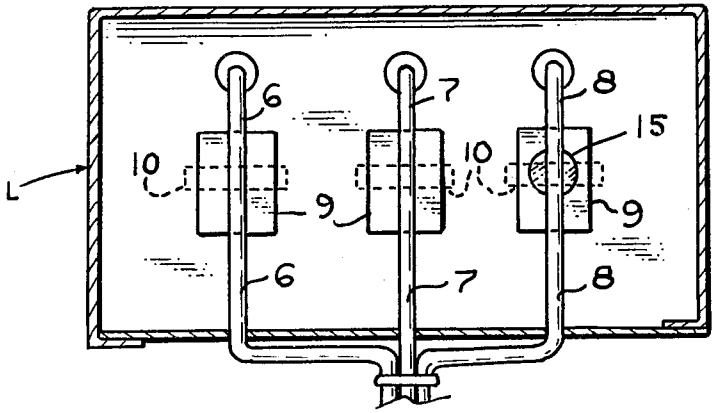
FIG-2
FIG-3
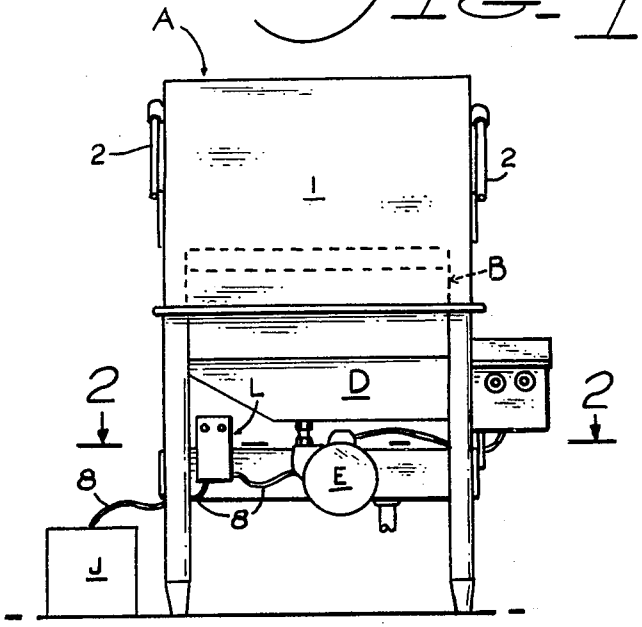

DISHWASHER UTILIZING PUMP IMPELLER SUCTION FOR FEEDING DETERGENT, SANITIZING AGENT AND RINSE AID IN TIMED SEQUENCES

SUMMARY OF THE INVENTION

An object of our invention is to provide a commercial dishwasher in which a motor driven impeller causes wash water to be sprayed into the ware receiving compartment for washing the dishes for a predetermined time cycle and then the impeller forces rinse water to be sprayed onto the ware for a predetermined time cycle for rinsing the dishes. We make use of novel means created by the suction of the impeller for delivering a detergent into the wash water during the washing cycle and for delivering a sanitizing agent and a rinse aid into the rinse water during the rinse cycle. The sanitizing agent permits the rinse water temperature to be at 140° F., rather than the customary 180° F., for sanitizing the ware.

BRIEF DESCRIPTION OF THE DRAWINGS

FIG. 1 is a front elevation of the dishwasher.

FIG. 2 is an enlarged horizontal section taken along the line 2—2 of FIG. 1, and shows the arrangement of the several operating parts of the dishwasher.

FIG. 3 is a further enlarged horizontal section through the unit that controls the flow of detergent to the wash water and that controls the flow of sanitizing and rinse aid to the rinse water and is taken along the line 3—3 of FIG. 4.

DESCRIPTION OF THE PREFERRED EMBODIMENT

In carrying out our invention we show in FIG. 1, a front elevation of the dishwasher. The wash and rinse compartment A, is enclosed in the housing and is illustrated schematically in FIG. 7. The housing has a front door 1 which may be opened and closed by handles 2. Within the compartment A, we show a dish rack B for containing the dishes to be washed and rinsed. Upper and lower spray arms C, are positioned in the wash-/rinse compartment A and are shown schematically in FIG. 7. A water receiving tank D underlies the wash-/rinse compartment and receives water therefrom.

Figure 7:
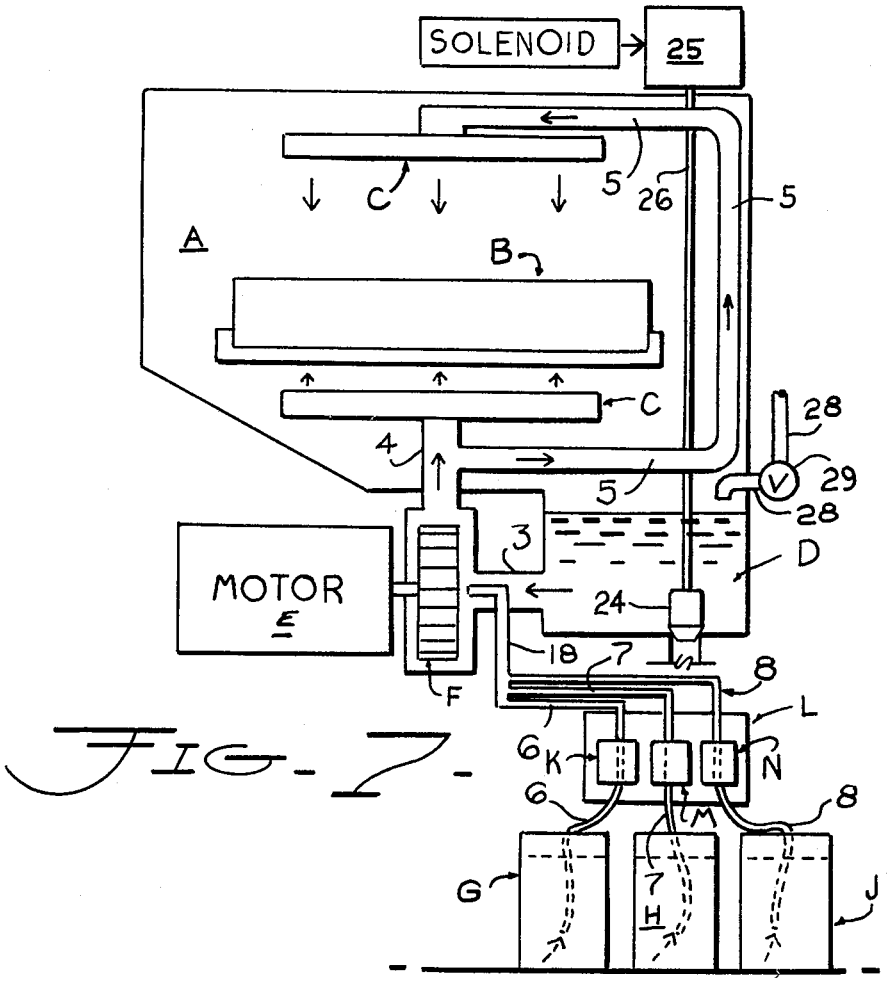
FIG. 7 is a schematic showing of the entire dishwasher and its operating parts.

Schematic FIG. 7, illustrates a motor E for driving an impeller pump F, and this pump receives water from the tank D through a pipe 3 and forces this water through a pipe 4 to the lower spray arm C. A branch pipe 5 connects the pipe 4 to the upper spray arm C so that when the impeller pump F, is operated by the motor E, it will force hot water through the pipes 4 and 5 and out through the two spray arms. The hot water returns to the tank D by gravity and is rady to be used again.

Figure 8:
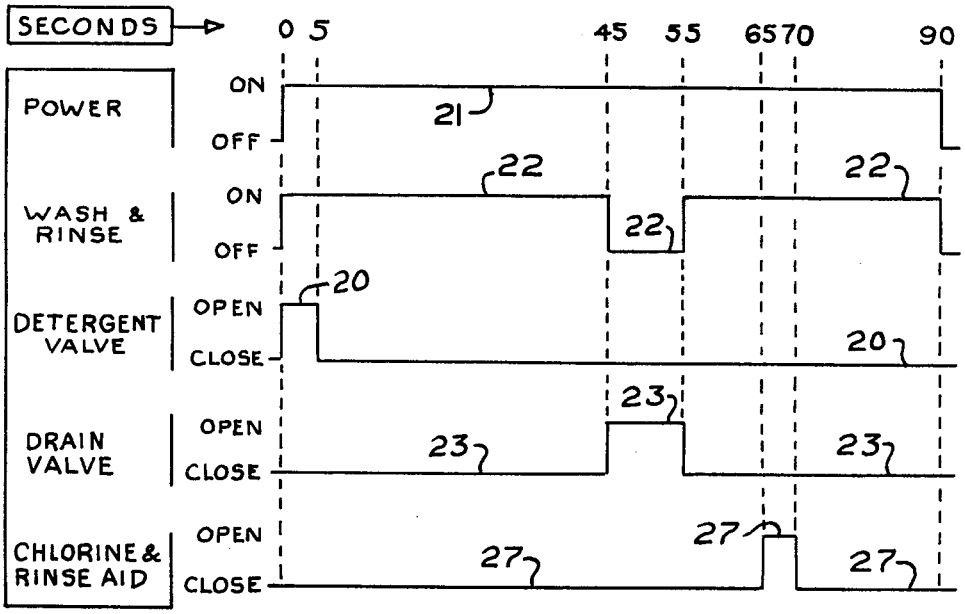
FIG. 8 is a timing cycle that predetermines the lengths of the wash and rinse cycles and the entrance of the detergent in the wash water and the simultaneous entrances of the sanitizing agent and the rinse aid in the rinse water.

The dishwasher is designed to operate through a dishwashing cycle followed by a combined dish rinsing and sterilizing cycle so that the rinse water can be at a temperature of 140° F., rather than the 180° F., which would be required if no sanitizing agent such as chlorine were used. In FIG. 8 we graphically show the two timing cycles one for washing the dishes and the other for rinsing and sterilizing the dishes. We also indicate when the detergent is added to the wash water and when the sanitizing agent and rinsing aid are added to the rinse water. Before describing the timing cycles in detail it is best to set forth how the detergent is delivered to the wash water and how the sanitizing agent and rinse aid are simultaneously delivered to the rinse water.

In FIGS. 2 and 7 we show a container G for the liquid detergent, a container H, for the sanitizing agent, such as chlorine, and a container J for the liquid rinse aid. A tube 6 leads from the detergent container G to a solenoid controlled valve K mounted in a housing L, see FIGS. 3 and 4. In like manner, another tube 7 leads from the sanitizing agent container H to a solenoid controlled valve M positioned in the housing L, and a tube 8 leads from the rinse aid container J to a solenoid controlled valve N. All three solenoid valves are identical to each other except that the solenoid valve N has a fine adjustment mechanism for controlling the flow of the rinse aid in the tube 8 which the other two solenoid valves K and M, do not need. Therefore the solenoid valve N will be described in detail and this will suffice for the other two solenoid valves.

Figure 5:
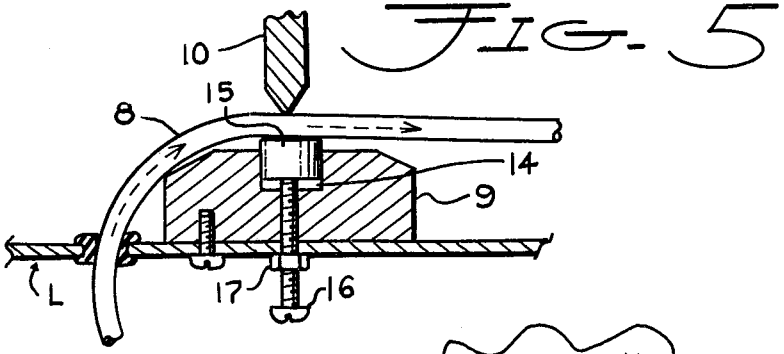
FIG. 5 is an enlarged section taken along the line 5—5 of FIG. 4 and illustrates the fine adjustment mechanism for controlling the flow of the rinse aid fluid in the depressible tube that conveys the fluid.
Figure 6:
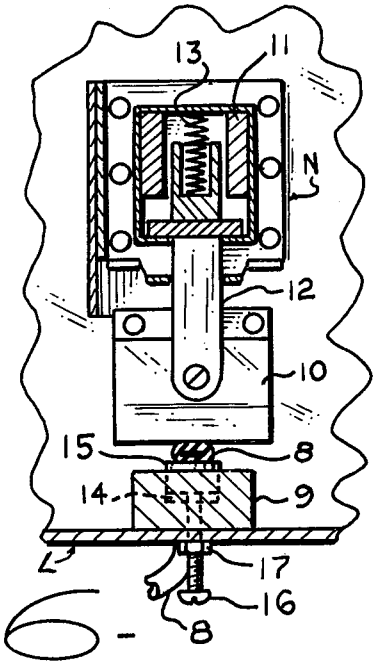
FIG. 6 is an enlarged section of the dotted circled portion of FIG. 4 and shows one of the solenoid controlled valves for opening and closing the fluid conveying tube. There is one of these solenoid controlled valves for each of the three tubes that convey the liquid detergent, sanitizing agent and the rinse aid.

FIGS. 5 and 6 illustrate the solenoid valve N, in detail. The tube 8 is shown lying between a block 9 and a tube compressing member 10. The solenoid 11 when energized by an electric current will lift a spring biased rod 12 and raise the tube compressing member 10 so as not to compress the tube 8 as is shown in FIG. 5. When the solenoid coil 11 is de-energized, a spring 13 will force the rod 12 to cause the member 10 to compress the tube 8 and stop any fluid flow therethrough. In addition to the closing and opening of the tube 8, we show a fine adjustment mechanism for varying the size of the passage in the tube 8 when the tube compressing member is raised and frees the tube. The block 9 has a recess 14 therein, see FIG. 6, in which an adjustable plunger 15 is mounted. A set screw 16 is threaded into a bore in the block 9 and the screw may be adjusted for slightly compressing the tube 8 even when the tube compressing member 10 is in raised position as shown in FIG. 5. A lock nut 17 on the set screw 16 secures the plunger 15 in adjusted position. In the present invention the solenoid valves K, and M do not need the fine adjustment plunger 15 and set screw 16 and are therefore not shown in FIG. 4.

One vital and novel feature of our invention lies in the manner of removing the liquid detergent from the container G, and for removing the liquid sanitizing agent from the container H, and the liquid rinse aid from the container J. Reference to FIGS. 2 and 7 shows the three tubes 6, 7 and 8 after being controlled by the solenoid valves K, M, and N, in a manner hereinafter described, communicate with a common tube 18 and the end of this tube is positioned adjacent to the greatest suction created by the impeller of the pump F, see especially FIG. 7. We have found that this suction created at the open end of the tube 18 is sufficient to entrain fluid through the common tube 18 and the separate tubes 6, 7 and 8 to remove liquid from the containers G, H, and J, this depending on which of the three tubes 6, 7 and 8 are not closed by the solenoid valves K, M, and L. This will be described more in detail hereinafter. The suction at the open end of the tube 18 is sufficient to draw a liquid detergent from the container G during the washing cycle and is sufficient to draw a liquid sanitizing agent from the container H, and a liquid rinse aid from the container J during the rinse and sanitizing cycle. This is a very important feature of our invention.

Figure 4:
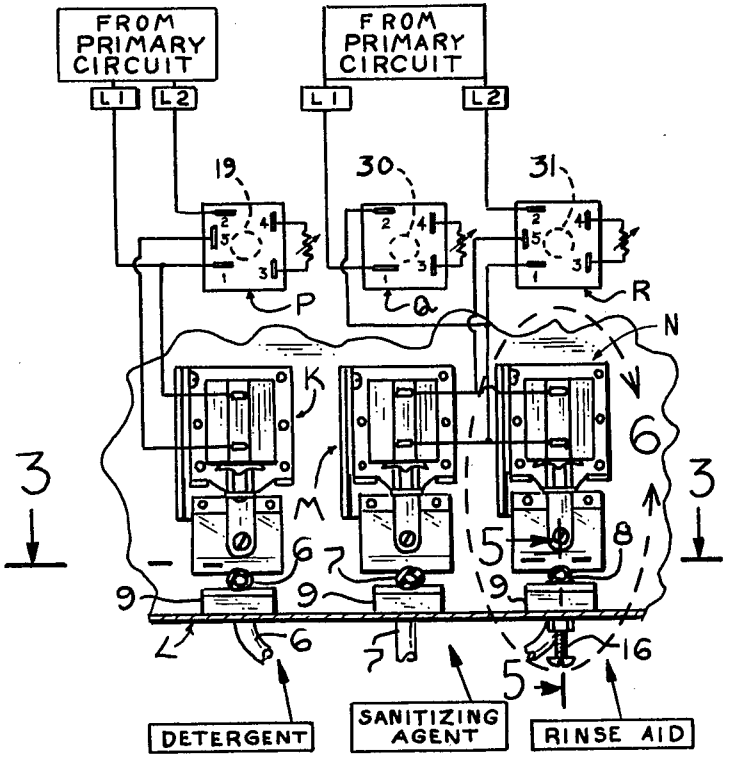
FIG. 4 is a schematic view of the three fluid control units for the detergent, sanitizing agent and rinse aid and their electrical connections with solid state control circuits.

A solid state electric control series of circuits are shown in FIG. 4 and these control the various timing cycles shown in FIG. 8 where it will be seen that the wash cycle is on for 45 seconds, then off for 10 seconds while the wash water is drained to the sewer and then the rinse cycle is on for 35 seconds after which the dishwasher automatically stops. These two cycles cover a period of 90 seconds which includes the 10 second time period for draining the wash water between the wash and rinse cycles. We do not wish to be confined to the exact timing of the wash and rinse cycles as indicated because the solid state electronic circuits shown in FIG. 4 have adjustable time delays shown at P, Q, and R. The time delay P controls the solenoid valve K for the detergent carrying tube 6 and the knob 19 can be adjusted to open the tube 6 for only 5 seconds at the start of the wash cycle to admit the liquid detergent into the wash water. In FIG. 8, the detergent line 20 is shown in open position only during the first five seconds of the washing cycle. The tank D, see FIG. 7, has previously been filled with hot wash water at 140° F. The spring 13 in the solenoid K will keep the detergent carrying tube 6 closed except for this 5 second period when it is open. Since the knob 19 is set for this 5 second opening of the detergent line 6, there is no need for using the fine adjustment set screw 16 and the plunger 15 and these therefore are not shown for the solenoid valve K.

The graph line 21 in FIG. 8, represents the duration that the electric power is on during the wash and rinse cycles and this is shown for a period of 90 seconds after which the power is automatically cut off. The next lower graph line 22 is the wash cycle and the rinse cycle line and the electric current to the motor E is on for the first 45 seconds for the wash cycle, then off for 10 seconds while the wash water is drained and then on for 35 seconds during the rinse cycle. The foruth graph line 23 is for the drain valve 24, shown diagrammatically in FIG. 7. A solenoid 25 is energized after 45 seconds of the wash cycle and lifts a rod 26 to open the valve 24 and drain the wash water into the sewer for a period of 10 seconds, after which the solenoid is de-energized and the drain valve closes.

The bottom graph line 27 in FIG. 8 represents the sanitizing agent (chlorine) and the rinse aid both of which are simultaneously introduced into the rinse water for a five second period. The adjustable timer Q controls the solenoid valve M for opening the chlorine carrying tube 7, see FIG. 4, for a period of five seconds during the rinsing cycle. At the same time the adjustable timer R, controls the solenoid valve N for opening the rinse aid carrying tube 9 for delivering the rinse aid into the rinse water. Very little rinse aid is required and that is why we use the set screw 16 for moving the plunger 15 for partially collapsing the tube 8 against the raised compressing member 10 so that a predetermined volume of rinse aid will flow through the tube during the five second interval while the solenoid valve N, is held open as indicated in graph line 27 of FIG. 8. The electronic circuits shown in FIG. 4 are regulated to function in the following manner. The knob 19 on the adjustable timer P causes the detergent valve K to open the tube 6 for five seconds at the start of the wash cycle as shown by the graph line 20 in FIG. 8. The suction created by the impeller pump F, is sufficient to draw liquid detergent from the container G, shown in FIG. 7, and deliver it into the wash water that flows through the pipe 4 and the spray arms C. After the wash cycle, the electronic circuit will energize the solenoid 25 in FIG. 7 to raise the rod 26 and open the drain valve 24 for emptying the tank D of its wash water, see the graph line 23 in FIG. 8. During this time, the motor E and the impeller pump F do not function.

Then the rinse cycle starts and functions and the graph line 22 in FIG. 8 shows the rinse cycle extending from the 55 second position on the chart and terminating at 90 second position at which point the rinse cycle terminates. Any means may be used for delivering fresh rinse water at 140° F., into the tank D, in FIG. 7, and we have shown schematically a fresh rinse hot water pipe 28 controlled by a valve 29 for delivering fresh rinse water into the tank starting at the 55 second position on the graph line 22. A predetermined volume of hot rinse water is delivered into the tank D, and then the valve 29 automatically closes by the electronic timing circuit.

The hot rinse water at 140° F., will be delivered to the impeller pump F which starts again at the 55 second position on the graph line 22 in FIG. 8. Then the electronic solid state circuits of FIG. 4 will cause the solenoid valves M, and N, both to open for five seconds, see the graph line 27 in FIG. 8. The solid state "ON" timer Q can be adjusted y the knob 30 and the "OFF" timer R can be adjusted by the knob 31 so that the solenoid valves M and N, will open for the five second intervaL during the rinse cycle. The hot rinse water at 140° F., is sufficient to sterilize the dishes during the rinse cycle because the sanitizing agent, chlorine, has been added. The sterilizing agent is removed from the container H by the suction created by the impeller pump F, and this suction will create an entraining action in the common tube 18 sufficient to deliver the strerilizing agent into the rinse water. The same holds true for removing a predetermined volume of rinse aid from the container J when the solenoid valve N is ópened. Again, the suction created by the impeller pump F will entrain the rinse aid from the common tube 18 and the rinse aid tube 8 that has its inlet end submerged in the rinse aid liquid in the container J.

I claim:

1. In a dishwasher:

(a) a wash/rinse compartment for receiving dishes and having spray arms therein for spraying wash or rinse water onto the dishes;

(b) a tank underlying said compartment for receiving wash or rinse water therefrom;

(c) a motor driven impeller for receiving wash or rinse water from said tank and forcing it through said spray arms and onto the dishes;

(d) a container for holding a liquid detergent;

(e) a valve controlled conduit leading from said container, the conduit having an open end disposed adjacent to the center of said impeller where the greatest suction is created, this suction being the sole means for removing the detergent from said container and delivering it to the area surrounding the impeller where the detergent is mixed with the wash water as it passes from the tank and is forced through said spray arms for washing the dishes; and (f) means for timing the opening and closing of the valve for delivering the proper volume of detergent into the wash water at the proper time.

2. The combination as set forth in claim 1 further defined by (a) means for draining the wash water at the end of the wash cycle and delivering rinse water to said tank;

(b) a container for holding a sanitizing liquid with a rinse sanitizing control valve leading therefrom and communicating with the conduit whose open end is disposed adjacent to the impeller where the greatest suction is created for entraining the sanitizing liquid and mixing it with the rinse water; and (c) means for timing the opening and closing of the rinse valve for delivering the proper volume of sanitizing liquid into the rinse water at the proper time.

3. The combination as set forth in claim 2 further defined by (a) a container for holding a rinse aid liquid and having a rinse aid conveying tube controlled by a rinse aid valve leading therefrom and communicating with the conduit whose open end is disposed adjacent to the impeller where the greatest suction is created for entraining the rinse aid liquid amd mixing it with the rinse water; and (b) means for timing the opening and closing of the rinse aid valve for delivering a predetermined volume of rinse aid liquid into the rinse water at a predetermined time.

4. The combination as set forth in claim 3 further defined by (a) adjustable means associated with the rinse aid conveying tube for restricting the passage in the tube to an adjustable extent so that said predetermined amount of the rinse aid liquid flows through the tube while the rinse aid valve is open.

* * * * *